US006415578B1

(12) United States Patent
DiCamillo

(10) Patent No.: US 6,415,578 B1
(45) Date of Patent: Jul. 9, 2002

(54) METHOD AND APPARATUS FOR BRICKLAYING

(76) Inventor: Jay E. DiCamillo, 13712 Jack McClure Rd., Farmington, AR (US) 72730

( * ) Notice: Subject to any disclaimer, the term of this patent is extended or adjusted under 35 U.S.C. 154(b) by 0 days.

(21) Appl. No.: 09/522,659

(22) Filed: Mar. 10, 2000

(51) Int. Cl.[7] ..... E04B 2/08

(52) U.S. Cl. ..... 52/747.12; 52/435; 52/417

(58) Field of Search ..... 52/747.12, 435, 52/417, 592.6, 436, 589.1, 592.5

(56) References Cited

U.S. PATENT DOCUMENTS

| | | | | | |
|---|---|---|---|---|---|
| 3,641,731 | A | * | 2/1972 | Winfree | 52/747 |
| 4,107,894 | A | * | 8/1978 | Mullins | 52/593 |
| 4,238,915 | A | * | 12/1980 | Yoshida et al. | 52/510 |
| 4,334,397 | A | * | 6/1982 | Hitz | 52/687 |

* cited by examiner

*Primary Examiner*—Beth A. Stephan
*Assistant Examiner*—Naoko Slack
(74) *Attorney, Agent, or Firm*—Head, Johnson & Kachigian

(57) ABSTRACT

The invention provides a device that may be used to quickly lay bricks to form a wall at a construction site. The device permits multiple layers of bricks to be quickly aligned and laid to form a mortarless wall. Mortar may be subsequently applied to the laid wall from the front to form a finished wall. The aligning device forms an integral portion of the finished wall. In one embodiment, each support includes an elongated frame that is attached to vertical columns of the interior superstructure with a reinforced shelf extending between the columns. The shelf includes a flat, rear wall with a transverse platform that protrudes outwardly to support bricks placed thereupon. A restraining clip projects angularly beneath the platform edge toward the rear wall to prevent brick dislodgement. An improved brick having a downwardly protruding stud may be used instead of conventional bricks to partially support the weight of the brick wall. Another improved brick with alternating male studs and female receivers may be deployed as well. A plurality of disparate spacers or a web of spacers that work in conjunction with a plurality of restraining clips may also be employed.

8 Claims, 3 Drawing Sheets

METHOD AND APPARATUS FOR BRICKLAYING

BACKGROUND OF THE INVENTION

1. Field of the Invention

The present invention relates generally to an improved method of construction and apparatus pertaining thereto. In particular, the present invention relates to a method and apparatus for laying bricks by initially aligning and laying a multitude of bricks to form a mortarless wall and then applying mortar thereto.

2. Known Art

As will be recognized by those skilled in the art, bricklaying is an arduous, time-consuming task that often requires years to master. As a result, bricklayers or masons are highly skilled craftsmen in much demand. The demand for masons has intensified because of the recent boom in the construction industry. This demand has resulted in shortages of masons and increased construction periods for many projects. Several methods and apparatus have been previously proposed to help resolve the dilemma.

For example, U.S. Pat. No. 5,761,876 to Keady shows an apparatus and a method of using the apparatus for forming a wall. The invention includes a pair of vertical wall guides that have cross staves that hold stones in place until they set (the staves are then removed.) There is no lower support for the stones other than the prior layer of stones. Further, the stones are not supported at the rear but are rather held in place by the temporary retaining stave disposed at the front of the wall. The staves are removed when the wall is finished and the mortar has set.

Another example is shown in U.S. Pat. No. 3,236,924 to H. W. McClarney et al. This patent shows an apparatus and method for laying masonry units such as bricks or concrete blocks. The device provides means for supporting and aligning several masonry units with a masking grid and aligning devices penetrating the centers of the masonry units when laying the blocks or bricks. This device permits the builder to lay out several sections of blocks or bricks in a grid that may be subsequently filled with a slurried mortar. The masking grid prevent undue leakage of the slurried mortar from the wall during setting. However, this invention does not permit conventional mortar to be used with the wall. More importantly, it prevents frontal access to the laid wall as a result of the masking grid. The device is also designed to support the grid or wall of mortarless bricks or blocks from the base and not from the rear. Further, the alignment devices and masking grid are temporary in that they are to be removed from the wall once it sets. Another problem with this device is its reliance upon the holes found in some bricks. That is, some bricks don't have central holes and this disclosure makes no provision for such bricks.

Yet another problem with the foregoing device is the use of a dolly or cart adapted to move sections of a wall about the construction site. This is also problematic with U.S. Pat. No. 3,231,646 to N. H. Conder et al. shows a method for pre-casting masonry panels wherein the panel is assembled and then placed at a construction site with a dolly. The device uses a shelving arrangement for the bricks wherein a substantial number of bricks are held in place and mortar is subsequently applied. This apparatus appears to be limited in its capacity to handle multiple bricks and would be further be limited to construction sites where the dolly may move about the construction site.

U.S. Pat. Nos. 4,359,850, 4,074,503 and 3,374,589 show various devices for aligning and laying relatively few bricks.

These devices are of only general relevance in that they are not adapted to facilitate the quick construction of an entire wall. They are adapted to train and/or facilitate relative novices when laying bricks. Further, the devices are for temporary use only and do not form a portion of the finished wall.

The known art does not provide a device that enables multiple layers of bricks to be laid in place at a construction site. The known art also fails to provide an acceptable method for laying multiple layers of bricks and then subsequently applying mortar thereto. The known art also does not address the need to provide a suitable device and method for bricklaying that does not require extensive training and/or additional tools.

Thus, there exists a need in the art for an improved method and apparatus for laying bricks and building walls quickly and efficiently. An improved method would employ a device that enables relative novices to begin laying bricks with minimal instruction and/or training.

SUMMARY OF THE INVENTION

The present invention addresses the problems associated with the known art. The device includes a reinforced retaining framework or skeleton or matrix that is adapted to facilitate alignment of the bricks to form a mortarless wall. The matrix may also restrain the aligned bricks until the mortar is applied to the laid wall and sets to form a permanent wall. The matrix is adapted to be disposed to or on the interior superstructure of the building prior to or during brick placement. The matrix includes a plurality of supports that are adapted to be disposed in a manner that facilitates laying of a plurality of bricks to form a mortarless wall. The invention provides a device that may be used to quickly lay bricks to form a wall at a construction site. The device permits multiple layers of bricks to be quickly aligned and laid to form a mortarless wall. Mortar may be subsequently applied to the laid wall for form a finished wall. The method permits the aligning device to remain in the construction to form an integral portion of the finished wall.

In one exemplary embodiment, each support includes an elongated frame. Each frame spans spaced apart vertical columns of the interior superstructure. Each frame has spaced apart ends that are each attached to a respective column. Nails, screws, bolts, rivets or other conventional attachment devices may be used to secure the frame end to a respective column. Each frame includes a reinforced shelf that extends between the columns. The shelf includes a flat, rear wall extending between the spaced apart ends. A transverse platform protrudes outwardly from the rear wall. The reinforced platform supports bricks placed thereupon. A restraining clip projects angularly beneath the platform edge toward the rear wall. The restraining clip prevents laid bricks immediately beneath the frame from dislodging.

In use, the worker simply nails, screws, bolts or rivets or otherwise secures each end of the lowermost frame to the respective column. Ideally, the columns are approximately four feet apart. The next frame is secured to the columns above the lowermost frame. Additional frames are installed at approximately four inch intervals until the wall is complete.

The worker may then insert bricks onto each form, pressing the brick past the retaining clip. The adjacent bricks on each layer are horizontally spaced apart by approximately one half to one inch. After an entire wall of bricks has been laid, mortar may be pumped into the voids between adjacent bricks from the front of the mortarless wall. A conventional mortar gun or the like may be used to pump conventional paste-like mortar between the bricks. In this fashion, an operator may easily access the front of the mortarless wall to apply mortar while ensuring the cosmetic appearance of the wall remains unblemeished. After the mortar sets, the brick wall is complete.

In another exemplary embodiment, conventional bricks are not deployed. Instead, an improved brick having a downwardly protruding stud is used to partially support the weight of the brick wall. In this fashion, stress upon the superstructure of the building is reduced during bricklaying.

In yet another exemplary embodiment, conventional bricks are not deployed. Instead an improved brick have alternating male and female studs and receives are deployed. The alternating male and female studs and receivers facilitate brick alignment as well as partially support the weight of the brick wall. In this fashion, brick alignment is improved and stress upon the superstructure of the building is reduced during bricklaying.

In another exemplary embodiment, each support includes a plurality of disparate spacers that work in conjunction with a plurality of restraining clips to enable a user to quickly align and lay bricks to form a mortarless wall. Each spacer fits in a the center holes found in many conventional bricks to permit an operator to align the bricks. Each spacer includes a reinforced shelf that extends outwardly from a central body. The shelf includes spaced apart upper and lower flat walls upon which adjacent bricks rest so that the bricks are appropriately spaced. In another embodiment, the spacer may be a web with raised integral spacers. The web is placed on top of adjacent bricks in a layer to space them.

The clips are deployed by the user upon the spaced apart vertical columns of the interior superstructure. Each clip has spaced an end that is attached to a respective column via nails, screws, bolts, rivets or other conventional attachment devices. The clips protrude outwardly from the columns into the plane established by the rear of the laid bricks and into the bricks to secure the bricks to a respective column. The clips prevent the bricks from separating from the internal superstructure of the building.

In use, the worker simply lays the lowermost layer of bricks upon the ground or other supporting structure. The worker then places spacers in the uppermost central holes of all of the laid bricks and lays the next layer of bricks. The worker repeats the foregoing process until a desired wall height has been obtained. During bricklaying, the spacers ensure that the adjacent bricks on each layer are horizontally spaced apart by approximately one half to one inch.

After laying each layer of bricks, the worker attaches several clips via nails, screws, bolts or rivets or otherwise to the building superstructure to tie each layer of laid brick into the building. Thus, each additional layers is secured to the building at approximately four inch intervals until the wall is complete.

After an entire wall of bricks has been laid, mortar may be pumped into the voids between adjacent bricks from the front of the mortarless wall. A conventional mortar gun or the like may be used to pump conventional paste-like mortar between the bricks. In this fashion, an operator may easily access the front of the mortarless wall to apply mortar while ensuring the cosmetic appearance of the wall remains unblemeished. After the mortar sets, the brick wall is complete.

While it is contemplated that the invention will primarily find use with conventional wooden construction, it may also be used with metal construction. Thus, in buildings where steel beams and/or columns form the infrastructure, the frames may be welded, riveted, bolted or otherwise secured into place upon these beams and/or columns. The remainder of the method is the same.

Thus, a principal object of the present invention is to provide an improved method and apparatus for bricklaying.

Another object of the present invention is to provide a method for laying bricks that requires little training and/or additional tools.

Another object of the present invention is to provide an improved apparatus for laying bricks that enables multiple layers of bricks to be aligned and attached to a wall and mortar to be subsequently applied thereto.

A related object of the present invention is to provide an apparatus for laying multiple levels of bricks and subsequently applying mortar thereto.

Another basic object of the present invention is to reduce the requirement for skilled masons at construction sites.

Another object of the present invention is to provide a method for laying bricks that increases construction productivity and decreases construction periods.

DETAILED DESCRIPTION OF THE PREFERRED EMBODIMENTS

Figure 1:
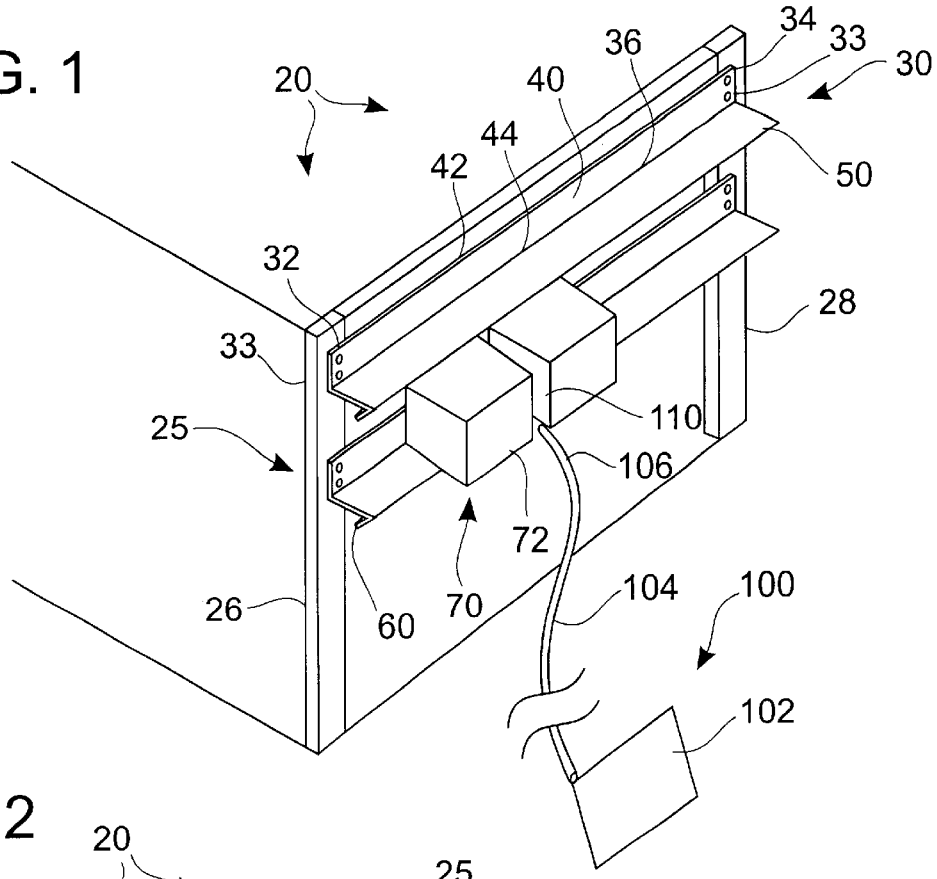
FIG. 1 is a environmental view of an exemplary embodiment of the present invention showing the improved method and apparatus for bricklaying.
Figure 2:
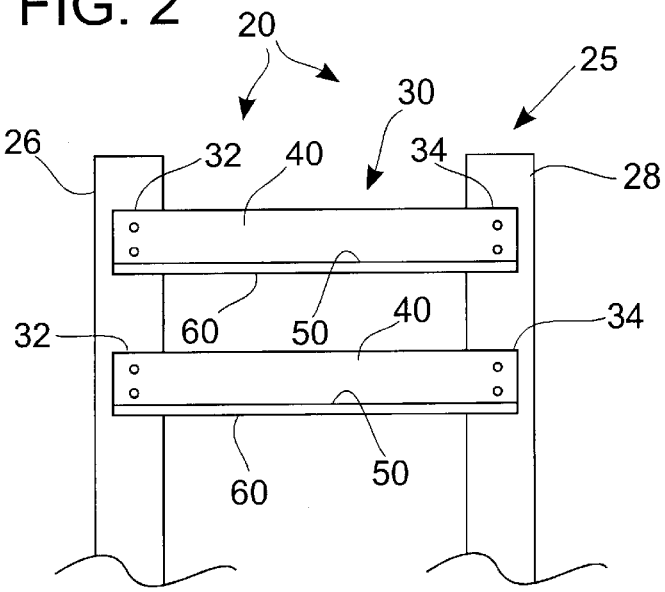
FIG. 2 is a partially fragmented, front elevational view thereof with portions omitted for clarity.
Figure 3:
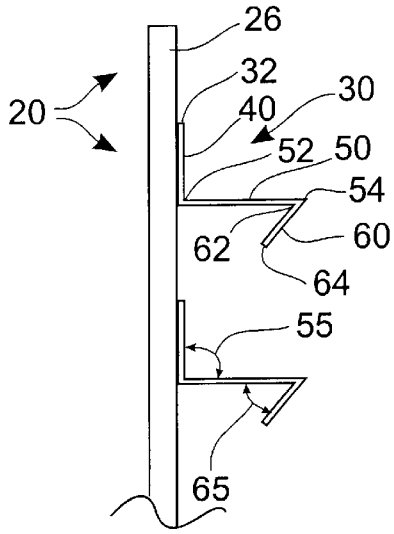
FIG. 3 is a partially fragmented side elevational view thereof, with the opposite side being a mirror image thereof.
Figure 4:
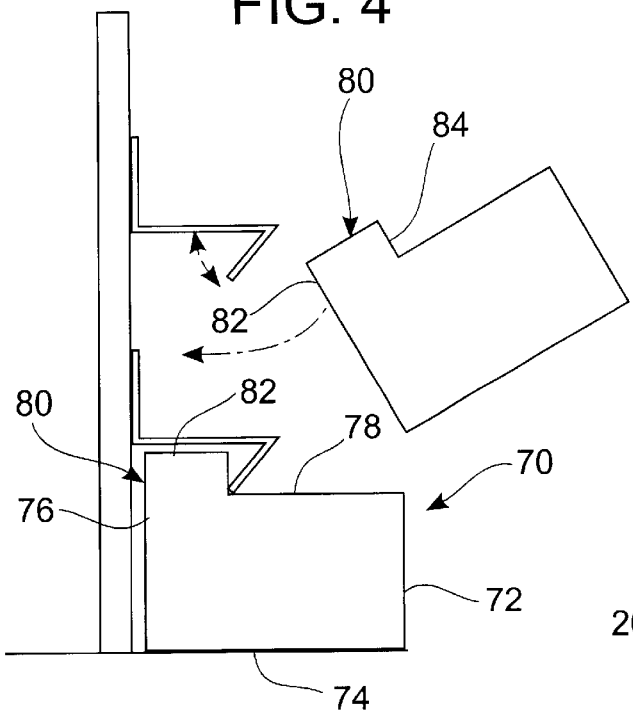
FIG. 4 is a side elevational view similar to FIG. 3, but showing a brick during insertion into the holder.
Figure 5:
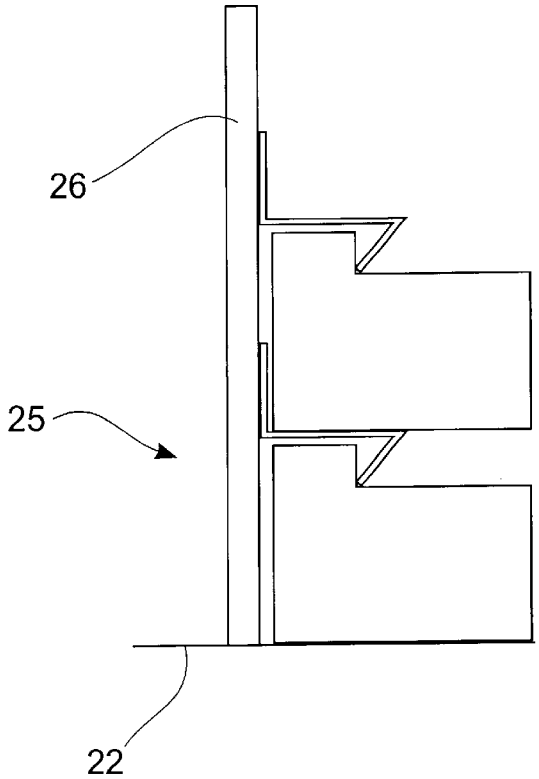
FIG. 5 is a side elevational view similar to FIGS. 3 and 4, but showing the brick inserted into the holder.
Figure 6:
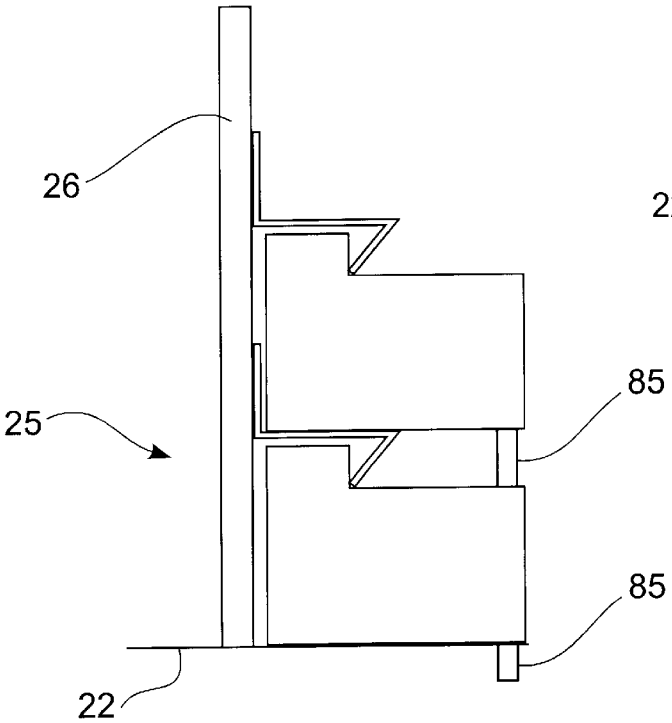
FIG. 6 is a side elevational view similar to FIGS. 3 and 4, but showing the brick inserted into the holder.
Figure 7:
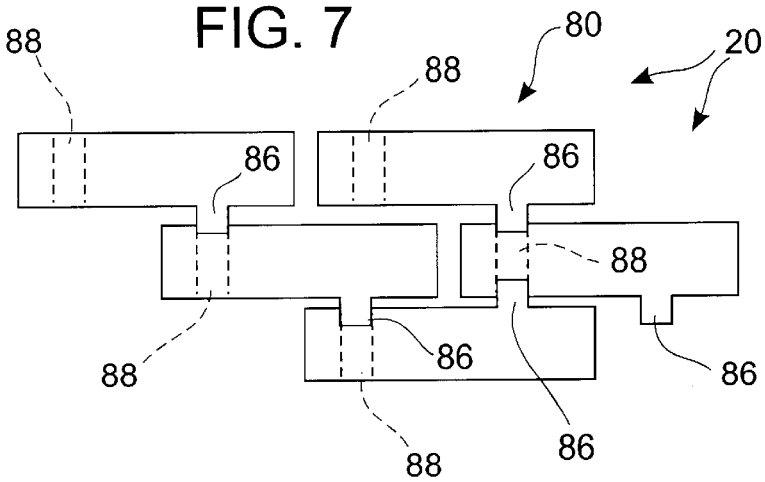
FIG. 7 is a partially fragmented front elevational view similar to FIG. 2 but showing another exemplary embodiment thereof.
Figure 8:
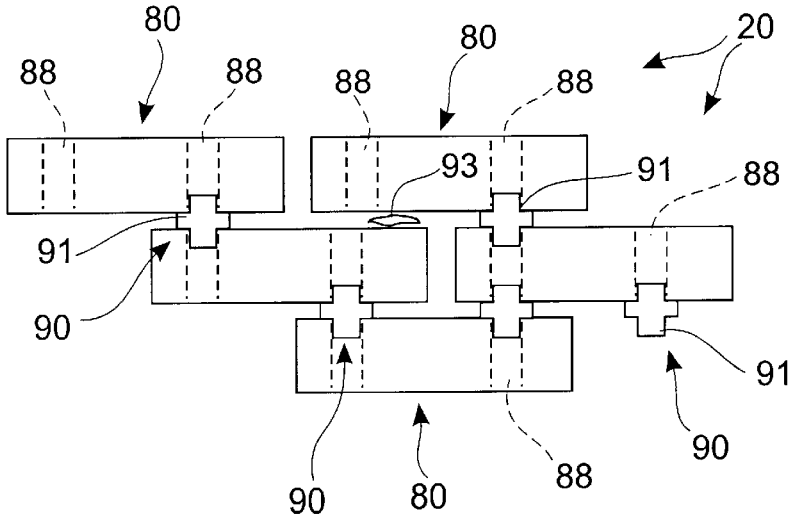
FIG. 8 is a partially fragmented front elevational view similar to FIG. 7 but showing another exemplary embodiment thereof.
Figure 9:
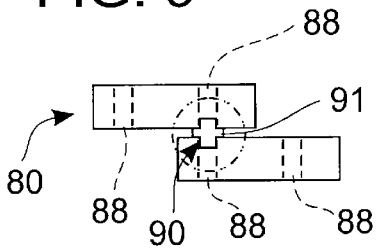
FIG. 9 is a partially fragmented front elevational view similar to FIG. 8 but showing another exemplary embodiment thereof.
Figure 10:
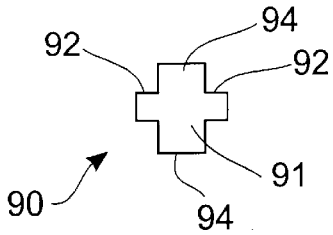
FIG. 10 is an exploded view of the encircled portion of FIG. 9.
Figure 11:
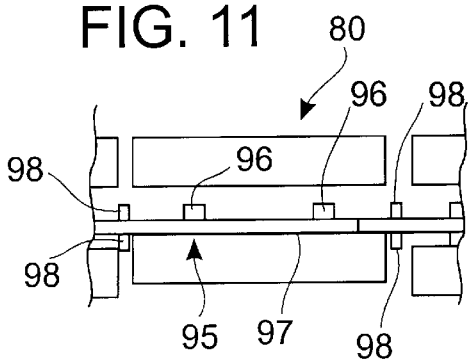
FIG. 11 is a partially fragmented front elevational view similar to FIG. 8 but showing another exemplary embodiment thereof.

The improved bricklaying system is generally designated by reference numeral 20 in FIGS. 1–11. System 20 enables a user to place multiple bricks on multiple layers to form a mortarless wall before applying mortar to form a finished wall. The system 20 may be deployed with a building under construction. System 20 has an internal superstructure 25 typically comprised of spaced apart columns 26 and 28. The spaced apart columns are typically on 2 or 4 foot centers. The columns may be wooden or metal.

In one embodiment, the system 20 includes an elongated frame 30 that extends between the columns 26 and 28. The elongated frame 30 includes spaced apart ends 32 and 34 with an intermediary body 36. Each end 32, 34 is penetrated by at least hole 33 that facilitates the installation of the end upon the respective column 26, 28.

Ideally, several frames 30 are deployed on the columns to support multiple layers of bricks. The frames may be spaced apart by 2–8 inches as desirable. If larger bricks are employed, the holders must necessarily be spaced appropriately. On the other hand, if smaller bricks are deployed, the holders may be spaced closer together.

The intermediary body 36 may be further segregated into a rear wall 40 and a supporting shelf 50. The rear wall 40 preferably forms a planer rear boundary for the mortar and bricks. The rear wall also establishes the outer boundary for the construction superstructure.

The rear wall 40 includes an upper edge 42 and a lower edge 44. The lower edge 44 abuts against the integral projecting shelf 50.

Reinforced projecting shelf 50 includes an interior edge 52 abutting the wall edge 44 and a spaced apart outer most edge 54. Preferably, the wall 40 and shelf 50 form a 90° angle 55.

An integral retaining clip 60 extends downwardly from the shelf 50. Clip 60 includes an integral edge 62 abutting edge 54 and a spaced apart lowermost lip 64. Also, the lip 60 and shelf 50 preferably form a 45° angle 65.

The system 20 may be employed by a user with relatively little experience and with few additional tools. The user may then quickly and efficiently lay a wall of bricks by simply aligning the bricks in the system 20. After the bricks are inserted upon the system 20, the user may apply mortar to the assembled bricks from the front to thereby ensure that the cosmetic appearance of the bricks remain unblemished.

Each brick 70 of the wall is inserted into each frame 30 in a similar fashion. After insertion, the brick face 72 faces outward while the brick bottom 74 rests upon the support platform 50. The rear surface 76 is against the rear wall 40. The top 78 is substantially open. The retaining lip 80 is held in place by the retaining clip 60.

The retaining lip 80 comprises a projecting tab 82 with an inclined vertical keeper 84. Keeper 84 is adjacent the lowermost lip 64 of the clip 60.

During installation, the user first secures each end 32, 34 of the holder 30 to a respective beam 26, 28. These remaining employ nails, screws, bolts, rivets or other securing devices. The first layer of bricks is laid on the ground 22 or a similar lowermost supporting structure. The first holder is then placed on top of the lowermost level of bricks. Subsequent layers are appropriately spaced along the beams 26, 28 until the crest is achieved. Then, the user deploys bricks in an appropriate space relationship on each holder 30. Each brick 70 is inserted into the form holder 30 by pressing the brick into place until the retaining lip 60 snaps down adjacent top 78 and lip 84.

When finished inserting all of the bricks to form a wall, the user may then pump mortar into the wall. The user may employ any mortar source 100, although a conventional mortar gun works well. The mortar source 100 includes a pump and supply 102, a transmission line 104 and a nozzle 106. User deploys the nozzle 106 to deposit the mortar into the spaces 110 between adjacent bricks.

Once the mortar is pumped between the bricks and sets there, a unitary wall is formed and construction is substantially complete. The user need not remove the holders 30 nor otherwise modify the structure 25.

In another exemplary embodiment (FIG. 6), a slightly modified brick is deployed. The improved brick has a downwardly protruding stud 85 which is used to partially support the weight of the brick wall. In this fashion, stress upon the superstructure of the building is reduced during bricklaying.

In yet another exemplary embodiment (FIG. 7), a slightly modified brick is deployed. The improved brick has alternating male studs 86 and female receivers 88. The alternating male and female studs and receivers facilitate brick alignment as well as partially support the weight of the brick wall. In this fashion, brick alignment is improved and stress upon the superstructure of the building is reduced during bricklaying.

In another exemplary embodiment (FIGS. 8–10) each support 90 includes a plurality of disparate spacers 91 that work in conjunction with a plurality of restraining clips 93 to enable a user to quickly align and lay bricks 80 to form a mortarless wall. Each spacer 90 fits in the center holes 88 found in many conventional bricks to permit an operator to align the bricks. Each spacer includes a reinforced shelf that extends outwardly from a central body. The shelf includes spaced apart vertical and horizontal flat walls 92, 94 upon which adjacent bricks 80 rest so that the bricks are appropriately spaced.

The clips 93 are deployed by the user upon the spaced apart vertical columns of the interior superstructure. Each clip 93 has an end that is attached to a respective column via nails, screws, bolts, rivets or other conventional attachment devices. The clips 93 protrude outwardly from the columns into the plane established by the rear of the laid bricks and into the bricks to secure the bricks to a respective column. The clips prevent the bricks from separating from the internal superstructure of the building.

In another embodiment (FIG. 1, the spacer 95 may be a web 97 with raised integral spacers 96 and 98. The web is placed on top of adjacent bricks in a layer to appropriately space the bricks.

In use, the worker simply lays the lowermost layer of bricks upon the ground or other supporting structure. The worker then places spacers in the uppermost central holes of all of the laid bricks and lays the next layer of bricks. The worker repeats the foregoing process until a desired wall height has been obtained. During bricklaying, the spacers ensure that the adjacent bricks on each layer are horizontally spaced apart by approximately one half to one inch.

After laying each layer of bricks, the worker attaches several clips via nails, screws, bolts or rivets or otherwise to the building superstructure to tie each layer of laid brick into the building. Thus, each additional layers is secured to the building at approximately four inch intervals until the wall is complete.

After an entire wall of bricks has been laid, mortar may be pumped into the voids between adjacent bricks from the front of the mortarless wall. A conventional mortar gun or the like may be used to pump conventional paste-like mortar between the bricks. In this fashion, an operator may easily access the front of the mortarless wall to apply mortar while ensuring the cosmetic appearance of the wall remains unblemished. After the mortar sets, the brick wall is complete.

Whereas, the present invention has been described in relation to the drawings attached hereto, it should be understood that other and further modifications, apart from those shown or suggested herein, may be made within the spirit and scope of this invention.

What is claimed is:

1. An improved method for constructing a brick wall for a building comprising the steps of:

(a) aligning a lowermost layer of bricks and a plurality of higher layers of bricks to form a mortarless wall adjacent the exterior of the building, with each of said higher layers of bricks resting at least partially upon a lowermost layer of said bricks;

(b) restraining said bricks to prevent brick dislodgement;

(c) applying mortar to the front of said mortarless wall to form said brick wall while preserving the cosmetic outward appearance of said brick wall.

2. The improved method as recited in claim 1 wherein said step of aligning bricks includes the steps of:

(a) laying a first lowermost layer of bricks adjacent the building exterior;

(b) laying a subsequent layer upon said lowermost layer to form a subsequent layer of bricks, wherein said second layer is offset in a conventional manner from said lowermost layer;

(c) adding additional layers of brick until a desired height of a wall is reached to form said mortarless wall.

3. The improved method as recited in claim 2 wherein a plurality of supports is used to align each of said layers of bricks when forming said mortarless wall.

4. The method as recited in claim 2 wherein said plurality of supports comprises a plurality of frames adapted to space and align said layers of bricks.

5. The method as recited in claim 2 wherein said bricks include male studs protruding from a first side of said brick and female receivers recessing from a side opposite said first side whereby said bricks may be interconnected during said laying steps.

6. The method as recited in claim 2 wherein said plurality of supports comprises a plurality of spacers adapted to space and align said layers of bricks.

7. The method as recited in claim 2 wherein said plurality of supports comprises an elongated web with a plurality of protruding integral spacers adapted to space and align said layers of bricks.

8. An improved system for building a brick wall wherein a plurality of bricks are first aligned and stacked to form a mortarless wall and mortar is subsequently applied to the front of said mortarless wall to form a finished brick wall while preserving the outward cosmetic appearance of said finished brick wall, said system comprising:

a plurality of supports adapted to receive and align a plurality of bricks to form a series of layers that form a mortarless wall, said supports adapted to dispose said bricks to enable an operator to apply mortar to the front of said mortarless wall while preserving the cosmetic appearance of said wall and wherein said plurality of supports comprises a plurality of frames adapted to space and align and restrain said layers of bricks and wherein each of said layers of bricks is partially supported by the layer below it.

* * * * *